US005184548A

United States Patent [19]

Figi

[11] Patent Number: 5,184,548

[45] Date of Patent: Feb. 9, 1993

[54] CAN CRUSHING APPARATUS EMPLOYING A COOPERATIVE PLATE AND ANVIL ASSEMBLY

[76] Inventor: Scott R. Figi, 313 S. 2nds St. Apt. 1D, Oregon, Ill. 61061

[21] Appl. No.: 818,136

[22] Filed: Jan. 8, 1992

[51] Int. Cl.[5] ..... B30B 9/02; B30B 9/32

[52] U.S. Cl. ..... 100/73; 100/99; 100/113; 100/125; 100/131; 100/194; 100/265; 100/287

[58] Field of Search ..... 100/73, 113-116, 100/125, 131, 194, 265, 281, 287, 294, 902, 99

[56] References Cited

U.S. PATENT DOCUMENTS

| | | | |
|---|---|---|---|
| 134,910 | 1/1873 | Martin | 100/131 X |
| 170,467 | 11/1875 | Boomer | 100/99 X |
| 319,185 | 6/1885 | Boschert | 100/131 X |
| 458,650 | 9/1891 | Weston | 100/99 X |
| 818,796 | 4/1906 | Spengler | 100/125 X |
| 3,926,107 | 12/1975 | Dunlap et al. | 100/73 X |
| 4,604,949 | 8/1986 | Giese | 100/194 |
| 4,658,718 | 4/1987 | Buller-Colthurst et al. | 100/194 |

*Primary Examiner*—Harvey C. Hornsby
*Assistant Examiner*—Stephen F. Gerrity
*Attorney, Agent, or Firm*—Leon Gilden

[57] ABSTRACT

An apparatus to include a top plate and base plate, with a press plate reciprocatably mounted between the top plate and base plate to crush and deform various containers for disposal and recycling. The use of pivotal link members operative through an actuator rod directed medially of the link members at junctions thereof is directed for rotation to effect reciprocation of the press plate. The invention is arranged to further include drain apertures directed through the base plate. A modified aspect of the invention includes a capture plate positioned between the press plate and base plate and spring biased toward the top plate to secure cans therebetween. An underlying drawer is arranged to receive fluid from the cans, with a pesticide delivery and dispensing container arranged and mounted to the drawer for dispensing a pesticide and fungicide fluid into the drawer.

3 Claims, 4 Drawing Sheets

CAN CRUSHING APPARATUS EMPLOYING A COOPERATIVE PLATE AND ANVIL ASSEMBLY

BACKGROUND OF THE INVENTION

1. Field of the Invention

The field of invention relates to recycling apparatus, and more particularly pertains to a new and improved can crushing apparatus wherein the same effects deformation of cans for their subsequent compact storage and recycling.

2. Description of the Prior Art

Recycling of cans has reached proportions beyond prior art capacities of individual households to store such cans prior to their delivery to a recycling depot. Prior art capacity of crushing apparatus has been exceeded in contemporary recycling of cans and accordingly, the instant invention attempts to overcome deficiencies of the prior art by providing a can crushing apparatus of increased capacity effecting compact construction in its use. Examples of prior art crushing structure is set forth for example in U.S. Pat. No. 4,700,950 to Gardner utilizing a ram received within a housing to crush individual cans positioned between the ram and a top surface of the housing.

U.S. Pat. No. 4,821,969 to Fox, et al. sets forth an aluminum can crusher wherein the same is arranged to crush individual cans directed through a hopper aligning the cans between a ram and a backup plate.

U.S. Pat. No. 4,890,552 to Yelczyn sets forth a can crusher to crush individual cans between a press plate and a support plate.

U.S. Pat. No. 4,962,701 to Stralow sets forth a crusher structure to individually crush cans one at a time from an overlying hopper and deposit such cans into an underlying deposit bag.

As such, it may be appreciated that there continues to be a need for a new and improved can crushing apparatus as set forth by the instant invention which addresses both the problems of ease of use as well as effectiveness in construction in permitting crushing of a multiplicity of cans and in this respect, the present invention substantially fulfills this need.

SUMMARY OF THE INVENTION

In view of the foregoing disadvantages inherent in the known types of can crushing apparatus now present in the prior art, the present invention provides a can crushing apparatus wherein the same is arranged to receive a plurality of cans between a press plate and underlying base plate. As such, the general purpose of the present invention, which will be described subsequently in greater detail, is to provide a new and improved can crushing apparatus which has all the advantages of the prior art can crushing apparatus and none of the disadvantages.

To attain this, the present invention provides an apparatus to include a top plate and base plate, with a press plate reciprocatably mounted between the top plate and base plate to crush and deform various containers for disposal and recycling. The use of pivotal link members operative through an actuator rod directed medially of the link members at junctions thereof is directed for rotation to effect reciprocation of the press plate. The invention is arranged to further include drain apertures directed through the base plate. A modified aspect of the invention includes a capture plate positioned between the press plate and base plate and spring biased toward the top plate to secure cans therebetween. An underlying drawer is arranged to receive fluid from the cans, with a pesticide delivery and dispensing container arranged and mounted to the drawer for dispensing a pesticide and fungicide fluid into the drawer.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can crushing apparatus which has all the advantages of the prior art can crushing apparatus and none of the disadvantages.

It is another object of the present invention to provide a new and improved can crushing apparatus which may be easily and efficiently manufactured and marketed.

It is a further object of the present invention to provide a new and improved can crushing apparatus which is of a durable and reliable construction.

An even further object of the present invention is to provide a new and improved can crushing apparatus which is susceptible of a low cost of manufacture with regard to both materials and labor, and which accordingly is then susceptible of low prices of sale to the consuming public, thereby making such can crushing apparatus economically available to the buying public.

Still yet another object of the present invention is to provide a new and improved can crushing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
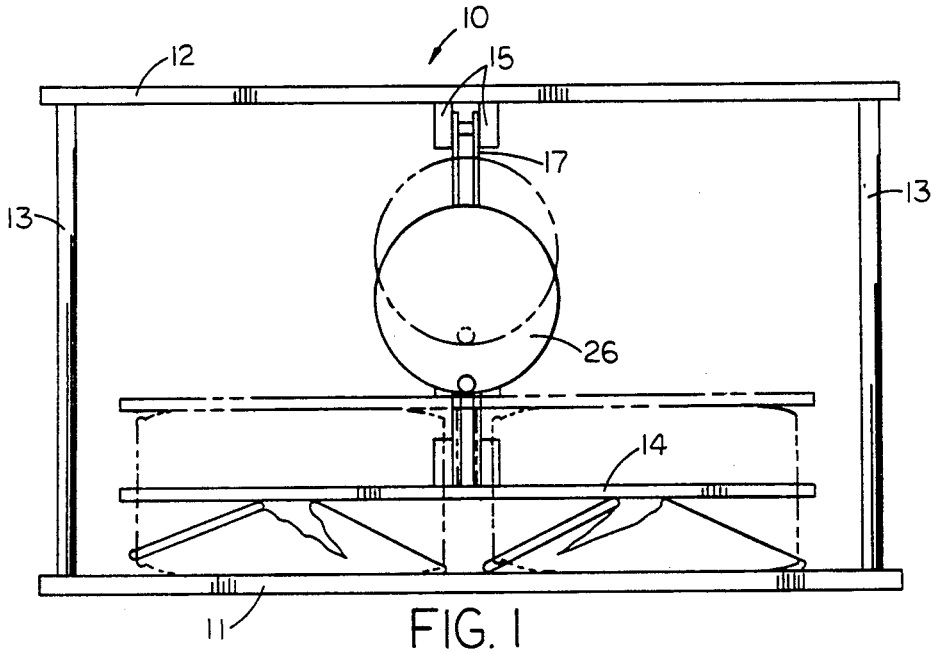
FIG. 1 is an orthographic end view of the instant invention.
Figure 2:
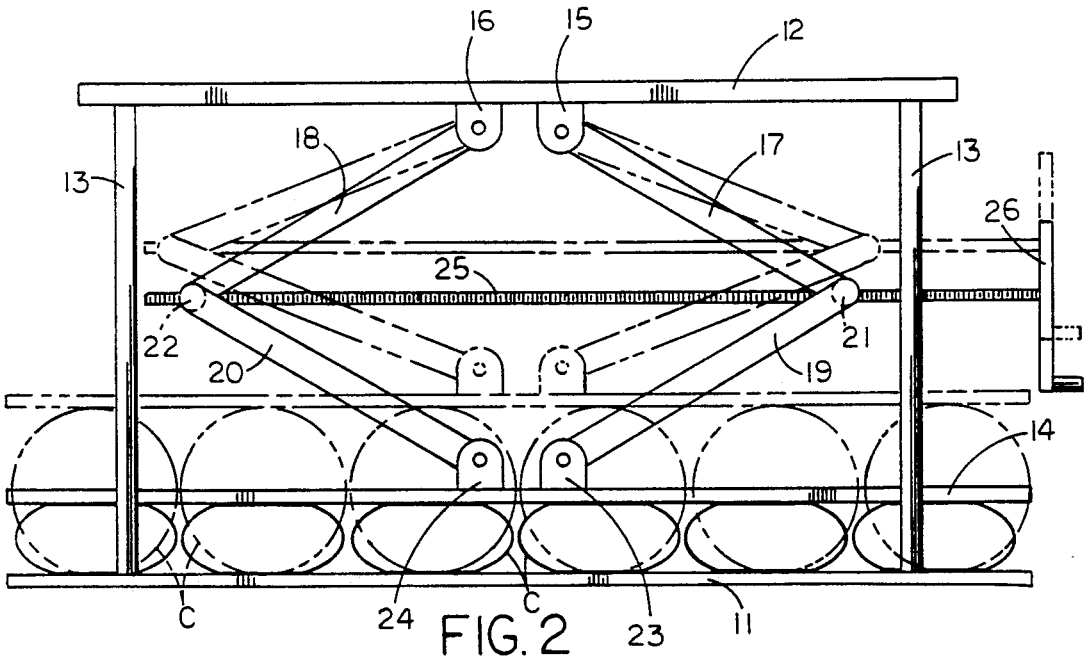
FIG. 2 is an orthographic side view of the instant invention.
Figure 3:
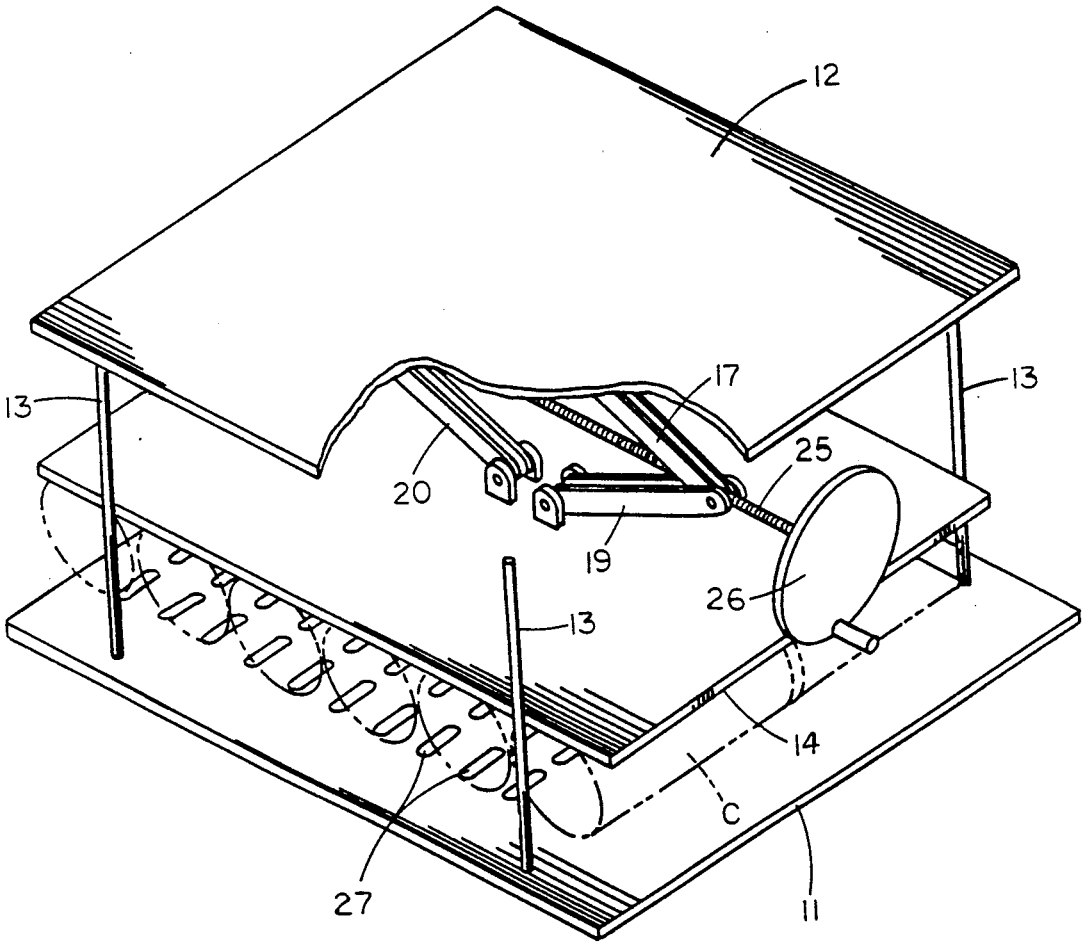
FIG. 3 is an isometric illustration of the invention.

With reference now to the drawings, and in particular to FIGS. 1 to 5 thereof, a new and improved can crushing apparatus embodying the principles and concepts of the present invention and generally designated by the reference numerals 10, 10*a*, and 10*b* will be described.

More specifically, the can crushing apparatus 10 of the instant invention essentially comprises a base plate 11 spaced below and parallel relative to a top plate 12. A plurality of frame posts 13 oriented adjacent each corner of the retilinear base plate and top plate and orthogonally oriented and mounted relative to the base plate and top plate secure the base and top plates 11 and 12 together. A press plate 14 arranged parallel to and between the base plate and top plate is reciprocated therebetween. A respective first and second boss pair 15 and 16 mounted to the top plate pivotally mount respective first and second link arms 17 and 18. Third and fourth boss pairs 23 and 24 respectively mounted to a top surface of the press plate pivotally mount third and fourth link arms 19 and 20 respectively, wherein the third and fourth link arms 19 and 20 are further pivotally mounted to the respective first and second link arms 17 and 18. A first pivot coupling 21 pivotally mounts the first link arms to the third link arms, with a second pivot coupling 22 pivotally mounting the second link arms to the fourth link arms. An externally threaded actuator rod 25 is threadedly directed through the first and second pivot couplings 21 and 22. The first and second pivot couplings 21 and 22 are reversely threaded, whereupon rotation of an actuator rod handle 26 to effect rotation of the actuator rod 25 effects the first and second pivot couplings 21 and 22 to be drawn towards one another or spread apart relative to one another to respectively depress or lift the press plate 14 relative to the base plate 11. A pluality of containers "C" are mounted between the press plate 14 and the base plate 11, wherein upon deflection of the press plate 14 downwardly, the plurality of cans "C" are thereby deformed and crushed.

Figure 4:
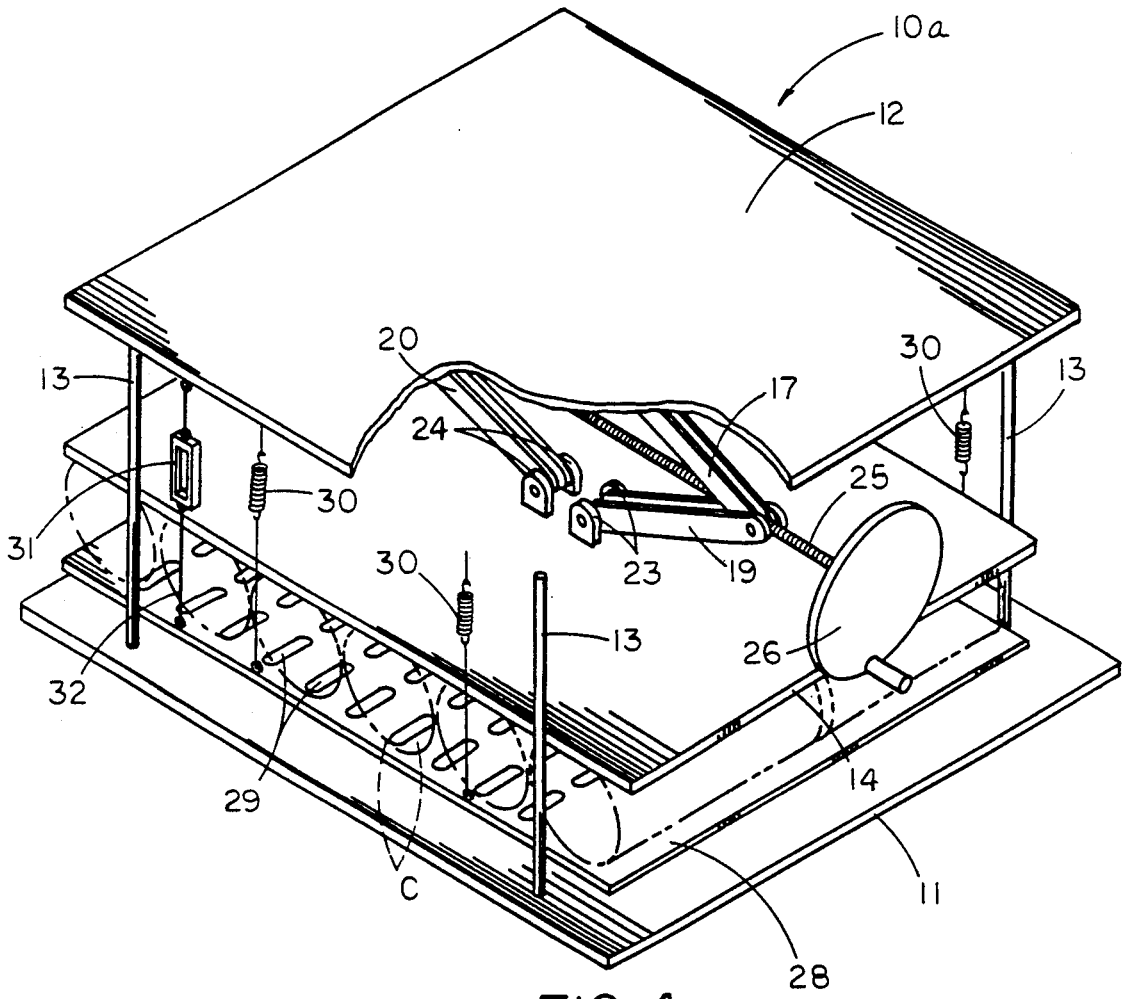
FIG. 4 is an isometric illustration of a modification of the invention.

A matrix of drain plate apertures 27 are directed through the base plate, wherein the apparatus is set forth in the FIG. 4 the modified apparatus 10*a* includes a capture plate 28, including a matrix of capture plate apertures 29 directed therethrough cooperating with the base plate apertures 27 to direct fluid from the can "C" through the apertures 27 and the apertures 29. The capture plate 28 is biased towards the top plate 12 by a plurality of support springs 30 secured at their opposed distal ends to the capture plate and to the base plate to bias the capture plate 28 towards a bottom surface of the press plate 14. Accordingly, the cans "C" are positioned between the capture plate and the press plate to permit positioning and alignment of the cans prior to their being crushed in cooperation with the base plate 11. A deflection scale 31 mounted to the top plate 12 includes a deflection rod 32 reciprocated within the deflection scale 31 to visually illustrate linear deflection of the capture plate relative to the top plate during a pressing procedure.

Figure 5:
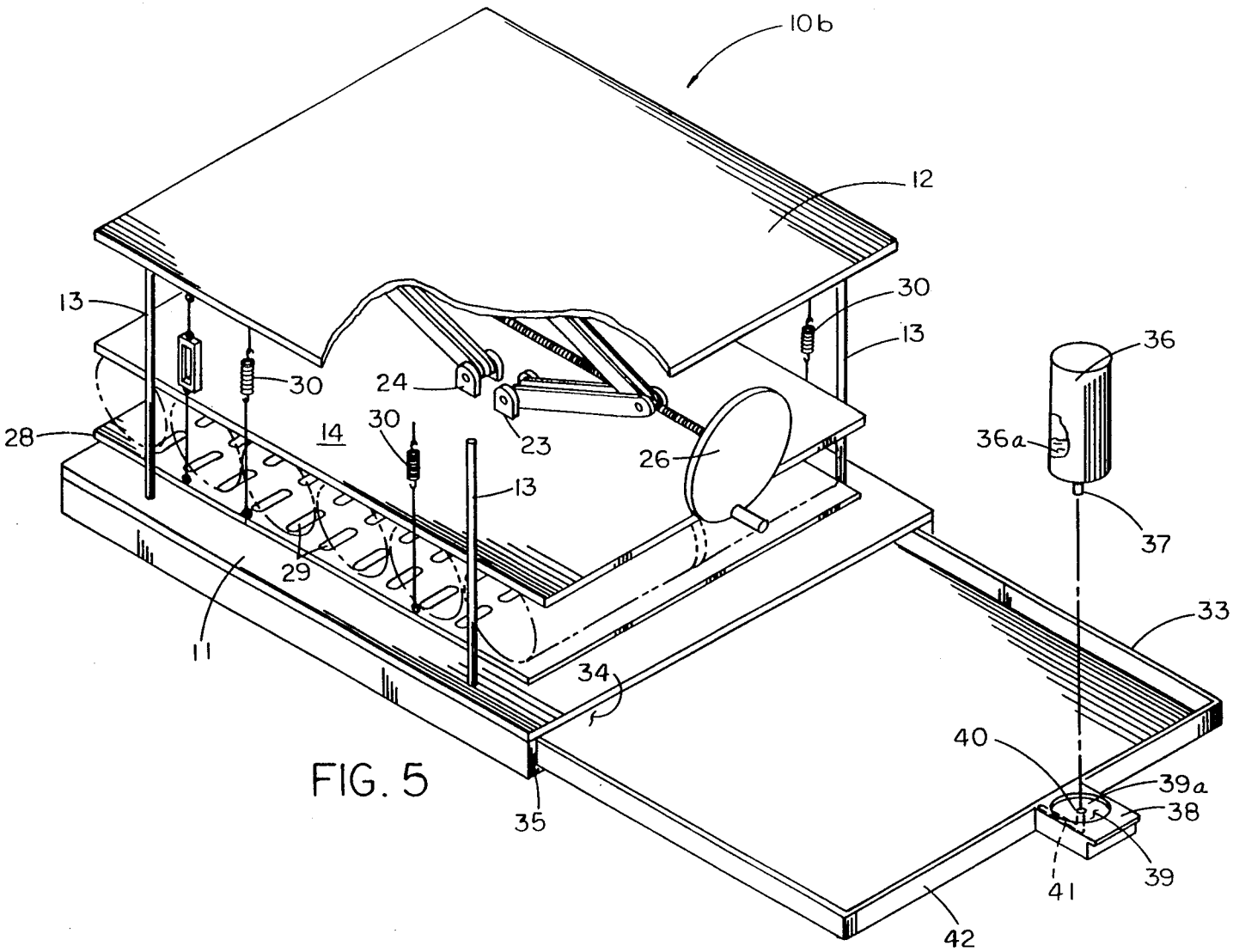
FIG. 5 is an isometric illustration of a further modification of the invention.

The further modified apparatus 10*b*, as illustrated in FIG. 5, further includes a fluid receiving slide drawer 33 positioned below the base plate apertures 27 and the capture plate apertures 29 to receive fluid within the drawer that is slidably mounted within a drawer slot 34. The drawer is coextensively positioned within the slot and coextensive with the bottom plate 11 during use. A drawer plate 35 spaced from and below the base plate receives the drawer 33 therebetween. A fluid container 36 including a pesticide and fungicide 36*a* therewithin includes a fluid container spout 37 directed therefrom positioned to a bottom wall of the container 36, wherein the container 36 is received within a container receiving boss 38 that is formed with a container receiving cavity 39 of a predetermined diameter substantiallly equal to the predetermined diameter defined by the container 36. A cavity floor 39*a* includes a spout-receiving bore 40 coaxially thereof to receive the container spout 37 therewithin. A delivery conduit 41 is directed from the spout-receiving bore 40 through a slide drawer front wall 42 to direct the fluid from the fluid container 36 into the drawer to insure the sanitary containment of fluid within the drawer as the pesticide and fungicide fluid prevents the growth of fungus and the like, as well as the discouragement of insects from encroaching into the drawer.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A can crushing apparatus, comprising, a base plate, the base plate spaced from and parallel to a top plate, with the top plate positioned above the base plate to include a plurality of frame posts orthogonally mounted to the base plate and top plate to fixedly space the base plate relative to the top plate, and a press plate reciprocatably mounted between the top plate and the base plate, and drive means positioned between the top plate and the press plate for effecting selective reciprocation of the press plate relative to the base plate. and a matrix of drain aperture directed through the base plate to permit drainage of fluid from can members positioned between the base plate and the press plate, and the drive means includes a first boss pair and a second boss pair mounted to a bottom surface of the top plate, and first link arms pivotally mounted to the first boss pair, and second link arms pivotally mounted to the second boss pair, and a third boss pair mounted to a top surface of the press plate, and a fourth boss pair mounted to a top surface of the press plate, and third link arms pivotally mounted to the third boss pair, and fourth link arms pivotally mounted to the fourth boss pair, and the first link arms and the third link arms pivotally mounted together, and the second link arms and the fourth link arms pivotally mounted together, and a first pivot coupling pivotally mounting the first link arms to the third link arms, and a second pivot coupling pivotally mounting the second link arms to the fourth link arms, and an externally threaded actuator rod directed threadedly through the first pivot coupling and the second pivot coupling, wherein the first pivot coupling and the second pivot coupling include reversely threaded bores directed therethrough to receive the externally threaded actuator rod therethrough, and an actuator rod handle fixedly and orthogonally mounted to a distal end of the actuator rod to effect selective reciprocation of the actuator rod, and a capture plate positioned between the press plate and the base plate, and the capture plate including a plurality of capture plate apertures directed through the capture plate, wherein the capture plate apertures cooperate with the base plate apertures to direct fluid therethrough, and a plurality of springs mounted between the capture plate and the top plate to bias the capture plate towards the press plate, and a deflection scale mounted to the top plate, wherein the deflection scale includes a deflection rod mounted to the capture plate to indicate deflection of the capture plate relative to the top plate.

2. An apparatus as set forth in claim 1 including a drawer slot positioned below the bottom plate, with a drawer plate positioned below the base plate to define a drawer slot in the drawer plate and the base plate, with a fluid-receiving slide drawer received within the drawer slot, wherein the slide drawer is arranged coextensively relative to the base plate and positioned therebelow to receive fluid directed through the capture plate apertures and the base plate apertures.

3. An aperture as set forth in claim 1 wherein the drawer plate includes a slide drawer front wall, wherein the slide drawer front wall includes a fluid container receiving boss fixedly mounted thereto, wherein the fluid container receiving boss extends exteriorly of the drawer, and the fluid container receiving boss includes a container receiving cavity, wherein the container receiving cavity includes a container receiving cavity floor, and a spout receiving bore positioned coaxially of the container receiving cavity floor, and a delivery conduit in fluid communication between the spout receiving drawer and the slide drawer, wherein the delivery conduit is directed through the slide drawer front wall, and further including a fluid container, the fluid container including a pesticide fluid therewithin, wherein the fluid container includes a container bottom wall, and the container bottom wall includes a container spout, and the container spout is sealingly received within a spout receiving bore, and the fluid container floor received in contiguous communication with the container receiving cavity floor.

* * * * *